US006086483A

United States Patent [19]

Brown

[11] Patent Number: 6,086,483

[45] Date of Patent: Jul. 11, 2000

[54] METHOD OF CUSTOM FITTING CLUBS INTEGRATED WITH SET UP POSITIONING

[76] Inventor: Philip J. Brown, 3351 McGinnis Ferry Rd., Alpharetta, Ga. 30201

[21] Appl. No.: 08/997,186

[22] Filed: Jun. 23, 1997

[51] Int. Cl.[7] ..... A63B 69/36

[52] U.S. Cl. ..... 473/218; 473/273; 473/409

[58] Field of Search ..... 473/218, 238, 473/243, 266, 267, 270, 273

[56] References Cited

U.S. PATENT DOCUMENTS

| | | | |
|---|---|---|---|
| 4,164,352 | 8/1979 | O'Brien | 473/218 |
| 4,384,718 | 5/1983 | Cachola | 473/218 |
| 4,538,815 | 9/1985 | Poirier | 473/218 |
| 4,915,387 | 4/1990 | Baxstrom | 473/218 |
| 5,306,011 | 4/1994 | Perry | 473/218 |
| 5,335,915 | 8/1994 | Baudier | 473/218 |
| 5,464,220 | 11/1995 | Hansen | 473/218 |
| 5,478,082 | 12/1995 | De Knight | 473/218 |
| 5,591,091 | 1/1997 | Hackman | 473/289 |

*Primary Examiner*—Jeanette Chapman
*Assistant Examiner*—Stephen L. Blau

[57] ABSTRACT

Firstly and foremost, the invention is novel and non-obvious because no entity or person known to the inventor as of the filing date is marketing any system, product or series of products that links or integrates a set up instrument to custom fitted golf clubs. The inventor believes that to a very significant degree, the golfers set up predetermines the motion. A golfer may set up to the ball perfectly and swing perfectly but if the golf clubs don't fit the golfer, the flight of the ball will definitely be compromised in a variety of ways. Or, a golfer may obtain custom fitted golf clubs but if he or she doesn't have a way to duplicate and reproduce the set up, which predisposes the swing, the golfer's swing will probably change, primarily, because the set up changed. The invention herein is much needed for golf game improvement because it systematically controls the most critical variables in golf. The inventor believes the SET UP and CUSTOM FITTED CLUBS go hand in hand.

2 Claims, 5 Drawing Sheets

FIG. 1 - SCALE: 3 1/2" = 1'-0"

FIG. 2 - SCALE: 3 1/2" = 1'-0"

FIG. 3 - SCALE: FULL

FIG. 4 - SCALE: FULL

METHOD OF CUSTOM FITTING CLUBS INTEGRATED WITH SET UP POSITIONING

BACKGROUND OF THE INVENTION

1. Technical Field

There are 2 components of SET UP MATIC: 1) a SET UP INSTRUMENT and 2) CUSTOM FITTED CLUBS. The present invention interdependently links CUSTOM FITTED GOLF CLUBS to a SET UP INSTRUMENT which calibrates to the golfers shoulder width and fingertips or wrists to the ground. The golfers set up for our purposes will be defined as AIM, (the aiming of the club face), ALIGNMENT, (the aligning of the body parallel with the target line), STANCE (width of feet for each club and feet angle at address), BALL POSITION, (lateral and perpendicular ball position for each club), and POSTURE, a result of having performed the foregoing components of the SET UP with CUSTOM FITTED GOLF CLUBS which employs a methodology consistent and compatible with the SET UP INSTRUMENT. It is critical that the two methodologies compliment each other if the goal of systematically controlling the known variables in golf is to be reached.

2. Description of the Related Art

At the present time, custom fitted golf club programs consist of a variety of approaches and methodologies. However, one problem and potential failure common to all the programs is this: THE GOLFERS CHANGING SET UP AND SWING HAS THE CAPABILITY OF DESTROYING WHAT THE CUSTOM FITTER CAN CREATE!! For example, one of the usual fitting considerations is the lie of the golf club. The loft of a golf club has a directional plane and the lie of the club establishes the directional plane of the loft. In other words, if a golfers set up and swing were perfect but the lie of the club was wrong for that person, the ball would fly off line, sometimes quite significantly. The lie of a club may be dynamically fitted for a golfer but if the golfers swing changes, the lie may no longer be right for the golfer. The same could hold true for other fitting variables.

The present invention makes great strides in solving the problem of the "changing swing". It is the belief, not only of the inventor but also of many of golfing's greatest players and instructors that "THE SET UP PREDETERMINES THE SWING". By controlling the SET UP the problem of the "changing swing" is greatly minimized. SET UP MATIC gets the golfer into a perfect set up for each club thereby insuring that what golf club fit the golfer during the fitting session will fit him or her in the future.

SUMMARY OF THE INVENTION

SET UP MATIC is used for practicing the SET UP, as defined herein, with CUSTOM FITTED GOLF CLUBS having a correlating and compatible methodology to that of a SET UP INSTRUMENT.

A golfer's SET UP predetermines the SWING. However, if the golfer's golf clubs do not fit, a perfect SET UP and SWING will not produce a good golf shot. The invention, as stated herein, would provide first for custom fitted golf clubs using static or dynamic information or both, taken from the subject player. Then, the CUSTOM FITTED GOLF CLUBS are produced and the SET UP INSTRUMENT with instructions are shipped to the golfer with the CUSTOM FITTED CLUBS. The SET UP INSTRUMENT helps to make and repeat a good golf swing and the CUSTOM FITTED CLUBS rewards a good golf swing. Through feedback from practice, SET UP MATIC systematically controls many of the known variables in golf.

BRIEF DESCRIPTION OF THE DRAWINGS

Please refer to FIGS. 1, 2, 3, 4 and 5 to view the drawings.

FIG 2 is also the receptacle for FIG. 3 and FIGS. 4 and 5.

DETAILED DESCRIPTION OF THE INVENTION

Figure 1:
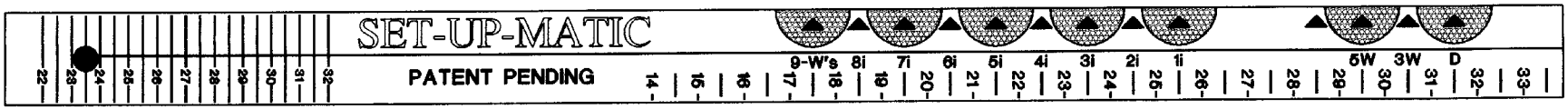
FIG. 1: When assembled, Part I shows the golfer where to place the clubhead for each club. The golfer should place the center of the bottom scoring line of the club directly over the number of the selected club, 1/16" behind the center line of Part I and the center scoring line directly behind the directional arrow. Also, the end of FIG. 1 that begins with the number 22 and ends with 32 are the numbers that correlate to the golfers dominant hand, middle fingertip to the ground measurement.

There are two parts to the invention that when used together as a system comprise the invention as defined herein. The first part is the SET UP INSTRUMENT shown on FIG. 5. The SET UP INSTRUMENT is what the golfer uses to perfect the SET UP after the golfer has received CUSTOM FITTED GOLF CLUBS which will have been made to fit the golfer with a "fitting methodology" that conforms with the methodology of the SET UP MATIC. The second part to the invention is CUSTOM FITTED GOLF CLUBS.

Please refer now to FIGS. 1, 2, 3, 4, and 5. To assemble the SET UP INSTRUMENT slide FIG. 4 over the end of FIG. 2 that ends with the number 25 to a point that the number corresponding with the golfers shoulder measurement can be clearly seen through the hole located in the middle of FIG. 4. Next, slide FIG. 3 over the other end of FIG. 2 until the number shown through FIG. 3's hole equals ½ of the golfers shoulder measurement. Next slide the end of FIG. 1 beginning with the number 22 into FIG. 3 until the number equaling the golfers middle fingertip measurement to the ground touches the leading edge of part III. The SET UP MATIC is now calibrated for the golfer to practice his/her set up for full shots which would be hit from turf without a tee. For the Driver, or #1 wood, which would normally be hit off a tee, FIG. 3 which assembled contains FIG. 1, should me moved to the left 2 ½". This is due to the fact that optimum ball flight is achieved with the driver when the golf ball is struck slightly on the upswing. When the SET UP INSTRUMENT is calibrated to the body of a golfer, he or she is now ready to practice the set up positions with his/her CUSTOM FITTED GOLF CLUBS.

The salient points of the CUSTOM FITTING GOLF CLUB methodology that correlates to the SET UP INSTRUMENT depicted herein is as follows:

1) The golfer's swing speed is recorded for the purpose of determining shaft flex.

2) The golfer's middle fingertip of the dominant hand to ground measurement is taken and a length of all the golfer's clubs is determined provided other bodily characteristics are not unusual enough to override the static measurement.

3) The golfer swings a 5 iron on to a "lie board" to determine how the club is coming through the hitting area.

These measurements along with other data gathered at the time of the fitting session are weighed and a decision on critical fitting factors is reached. To demonstrate how the features of the SET UP INSTRUMENT depicted herein are integrated with the fitting procedure, the following formulas should be understood:

* The mean fingertip measurement is 28" to the ground. For each inch away from the mean measurement, ¼" of length is added to the golf club. In addition to length, for each 1 ½" above 28", 1 degree of lie is added to the club making the club more upright. For each 1 ½" below 28" 1 degree of lie is subtracted making the club flatter. In this way, posture, a key to swinging in balance, becomes more standardized. Golf clubs cannot simply be made shorter for shorter fingertip measurements and longer for longer fingertip, measurements because, generally speaking, 1" of length =6 swing weights. The feel, total weight and swing weight can only be changed minimally or the golf club will no longer react or feel like a golf club.

Golfers of all sizes and shape can now practice their SET UP which predisposes the golf swing and CUSTOM FITTED GOLF CLUBS will reward a good swing.

Figure 2:
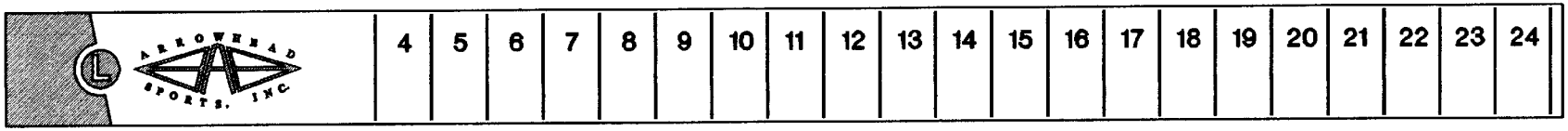
FIG. 2: The end depicting the L is the position of the left foot at address. The end terminating with the number 25 correlates with the golfers shoulder measurement. The middle numbers are for ½ the shoulder measurement and that position minus 2 ½" is the position for the Driver.
Figure 3:
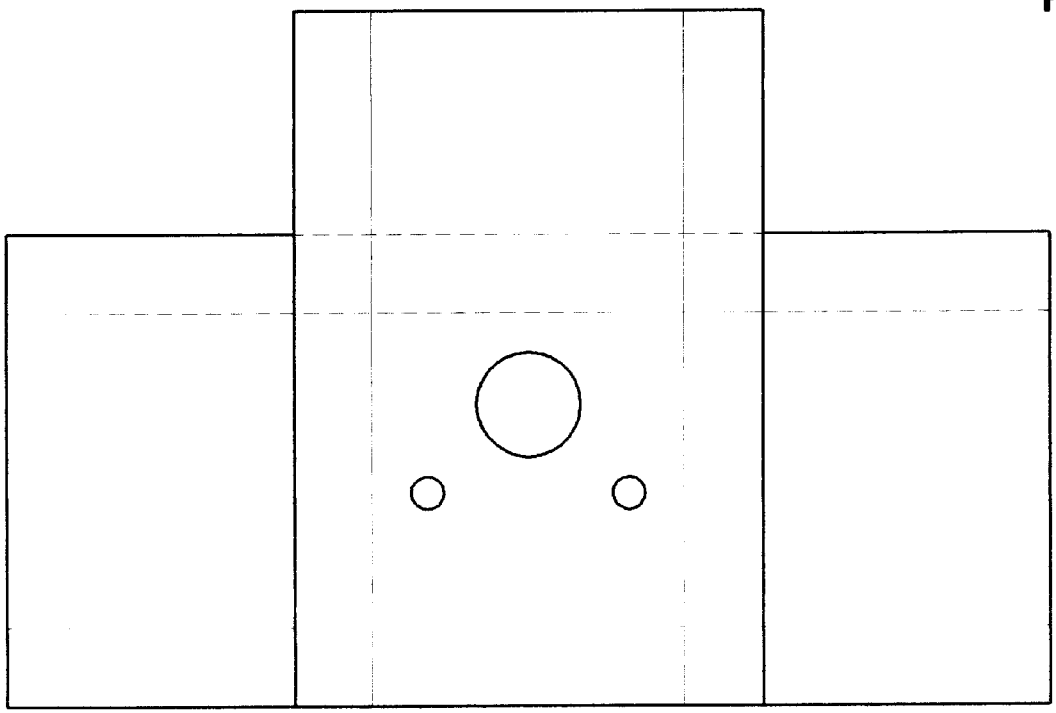
FIG. 3: Slides over the L end of FIG. 2 and holds FIG. 1 in place.
Figure 4:
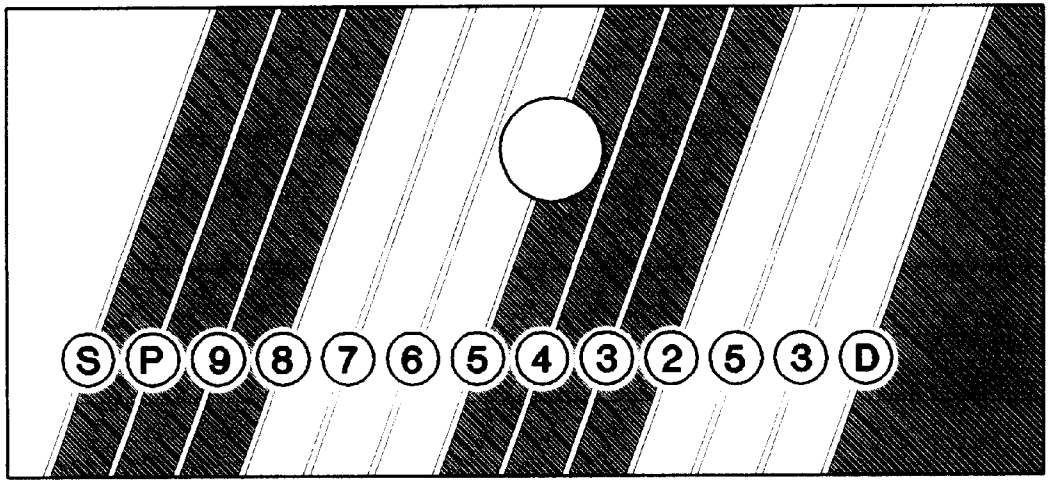
FIG. 4: When assembled, the Right foot indicator for each club.
Figure 5:
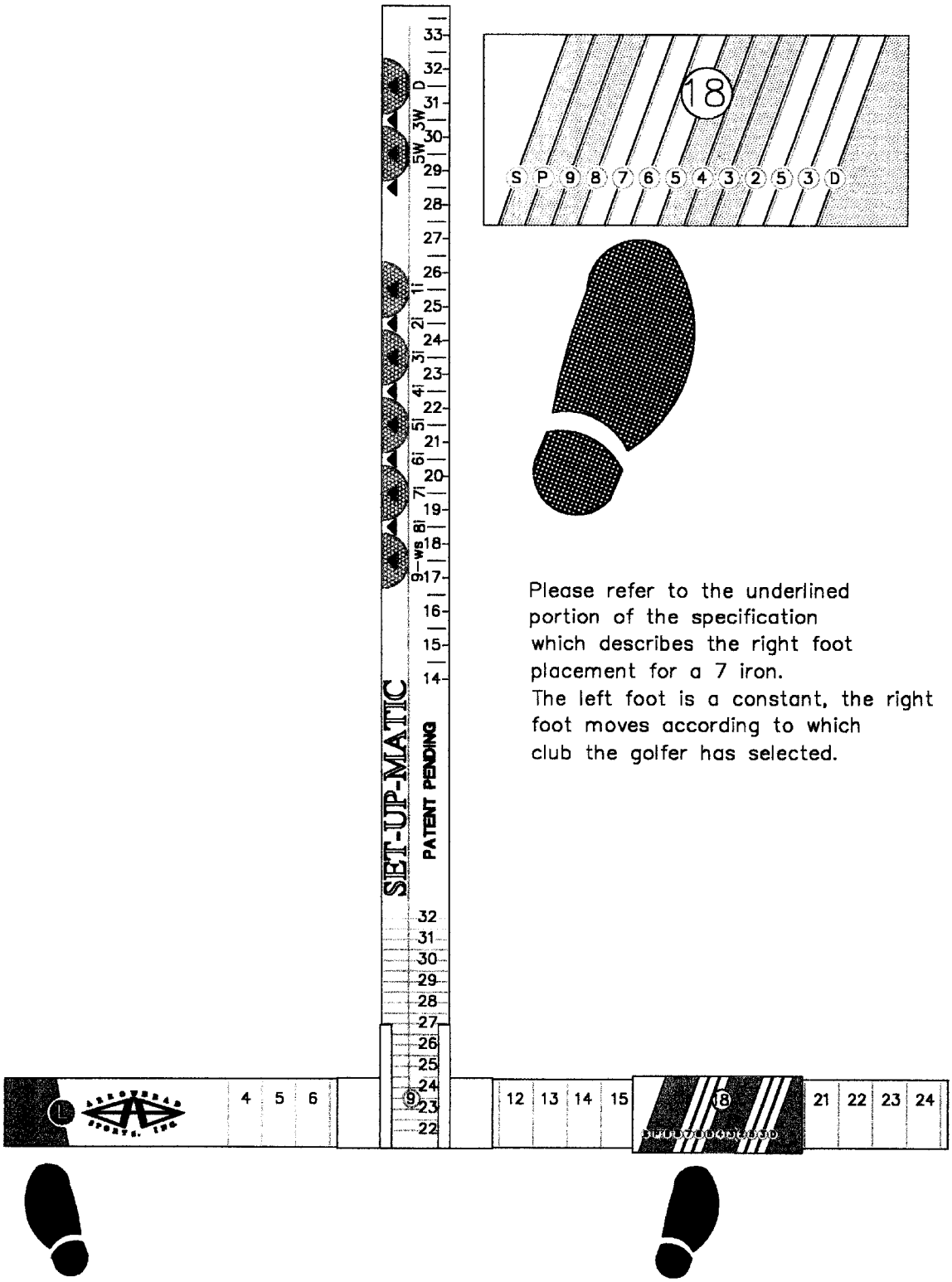
FIG. 5: Assembled SET UP INSTRUMENT for a golfer whose shoulder measurement is 18" and whose fingertip to the ground measurement is 27".

FIG. 5 shows an assembled SET UP INSTRUMENT for a golfer whose shoulder measurement is 18" and fingertip to the ground measurement is 27". When assembled, FIG. 1 succinctly shows the golfer where to place the clubhead. For instance, if a golfer has a 6 iron in his or her hand, he or she would place the center of the bottom scoring line on the face of the club directly on top of the 6i position and about 1/16" to the right of the line running down the center of FIG. 1. The arrow point directly in front of the middle of an accurately placed clubhead is a directional indicator. Also, the center line that runs down the middle of FIG. 1 is an indication of whether the clubhead is square, closed or open to the target. When assembled, the left end of FIG. 2 shows the golfer where the left foot is placed. The letter L located at the left end of FIG. 2 is for the placement and angle of the left foot at address. The golfer should stand about ½" from FIG. 2 and if the L (left foot) line were extended inward it should barely miss the inside of the left foot. FIG. 4 shows the golfer where the golfers right foot is placed. The letters and numbers located across the bottom of FIG. 4 have lines dissecting them. For instance, if the golfer has a 7 iron in his/her hand, the line dissecting the number 7 if extended inward should barely miss the golfers right foot, said line also indicating the right foot angle at the address position. When the golfer follows the directions for the SET UP INSTRUMENT using CUSTOM FITTED GOLF CLUBS employing the "matching" methodology, he or she is able to precisely perform & repeat the following components of the set up: Aim (aiming of the club face to a target), Alignment (aligning the body square to the target and parallel with the target line, Stance (stance width and feet angle at address for each club), Ball Position, (lateral and perpendicular) and Posture, a result of having accurately performed the other 4 components of the set up.

I claim:

1. A golf club set up instrument for use with a set of clubs, comprising:

a first strip having first indicia indicating where a golfer is to place a club head for each club in a set, and second indicia indicating different middle fingertip to ground measurements for different golfers;

a second strip having third indicia indicating proper position of a golfer's left foot, and fourth indicia indicating different shoulder measurements for different golfers;

a first slide slidably connected to said first strip and said second strip, said first slide in combination with said second strip having means to indicate a value which is a percentage of a golfer's shoulder measurement, and said first slide in combination with said first strip having means to indicate a golfer's middle fingertip to ground measurement; and a second slide slidably connected to said second strip having fifth indicia indicating proper position of a golfer's right foot for each club in a set, and said second slide in combination with said second strip means to indicate said golfer's shoulder measurement.

2. A method of custom fitting golf clubs and teaching a proper golfing set up utilizing a golf club set up instrument for use with said custom fitted golf clubs having a first strip having first indicia indicating where a golfer is to place a club head for each club in a set, and second indicia indicating different middle fingertip to ground measurements for different golfers;

a second strip having third indicia indicating proper position of a golfer's left foot, and fourth indicia indicating different shoulder measurements for different golfers;

a first slide slidably connected to said first strip and said second strip, said first slide in combination with said second strip having means to indicate a value which is a percentage of a golfer's shoulder measurement, and said first slide in combination with said first strip having means to indicate a golfer's middle fingertip to ground measurement; and a second slide slidably connected to said second strip having fifth indicia indicating proper position of a golfer's right foot for each club in a set, and said second slide in combination with said second strip means to indicate said golfer's shoulder measurement said method comprising steps of:

a. recording a golfer's swing speed;

b. taking a golfer's middle fingertip to ground measurement and comparing said measurement to a mean value, and adjusting a club length and lie based on a difference between said measurement and said mean value;

c. taking a dynamic lie test;

d. taking a golfer's shoulder measurement and adjusting said second slide to indicate the shoulder measurement and proper position of a golfer's right foot;

e. adjusting said first slide to indicate a value which is a percentage of said golfer's shoulder measurement;

f. moving said first strip along said first slide until the golfer's middle fingertip to ground measurement is indicated; and g. locating proper club head position on said first strip.

* * * * *